US010808401B2

(12) United States Patent
Awasthi et al.

(10) Patent No.: US 10,808,401 B2
(45) Date of Patent: Oct. 20, 2020

(54) CEILING SUPPORT SYSTEMS

(71) Applicant: Air Distribution Technologies IP, LLC, Milwaukee, WI (US)

(72) Inventors: Mayank Awasthi, Pune (IN); Smruti Kharche, Pune (IN); Wah G. Jeung, Wylie, TX (US); Brian J. Solis, Frisco, TX (US); Steven J. Purdie, Allen, TX (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 76 days.

(21) Appl. No.: 16/002,849

(22) Filed: Jun. 7, 2018

(65) Prior Publication Data

US 2018/0355610 A1 Dec. 13, 2018

Related U.S. Application Data

(60) Provisional application No. 62/517,741, filed on Jun. 9, 2017.

(51) Int. Cl.

| | |
|---|---|
| ***E04B 9/20*** | (2006.01) |
| ***E04B 9/06*** | (2006.01) |
| ***E04B 9/30*** | (2006.01) |
| ***E04B 9/12*** | (2006.01) |
| ***E04B 9/04*** | (2006.01) |

(52) U.S. Cl.

CPC ..... *E04B 9/065* (2013.01); *E04B 9/0428* (2013.01); *E04B 9/067* (2013.01); *E04B 9/127* (2013.01); *E04B 9/30* (2013.01); *E04B 9/064* (2013.01)

(58) Field of Classification Search

CPC ... E04B 9/10; E04B 9/18; E04B 9/064; E04B 9/065; E04B 9/067; E04B 9/0428; E04B 9/30; E04B 9/127

USPC ..... 52/653.1

See application file for complete search history.

(56) References Cited

U.S. PATENT DOCUMENTS 3,232,021 A * 2/1966 Wilson ..... E04B 9/064 52/507
3,327,438 A * 6/1967 Cooper ..... E04B 9/14 52/205
3,855,909 A 12/1974 Lambert
(Continued)

FOREIGN PATENT DOCUMENTS

GB 2245010 12/1991

*Primary Examiner* — Joshua J Michener
*Assistant Examiner* — James J Buckle, Jr.
(74) *Attorney, Agent, or Firm* — Fletcher Yoder, P.C.

(57) ABSTRACT

A ceiling support system includes a support beam configured to enable modular assembly of the dropped ceiling and including a core portion. A length of a face of the core portion extends along a first axis transverse to a length of first and second lateral sides of the core portion, which extends along a second axis. The support beam includes a base, a first hook extension having a first clip ledge extending from the first lateral side of the core portion and a first lip extending from a first distal edge of the first clip ledge, and a second hook extension having a second clip ledge extending from the first lateral side of the core portion and a second lip extending from a second distal edge of the second clip ledge. The first hook extension and the second hook extension are configured to receive a slidable joining clip therebetween.

25 Claims, 6 Drawing Sheets

(56) References Cited

U.S. PATENT DOCUMENTS

| | | | | |
|---|---|---|---|---|
| 4,543,755 | A * | 10/1985 | Crandell | E06B 3/5427 52/204.62 |
| 5,077,951 | A * | 1/1992 | Baker | E04B 9/0478 52/106 |
| 5,613,759 | A * | 3/1997 | Ludwig | E04B 9/006 362/149 |
| 7,886,496 | B1 * | 2/2011 | Spransy | E04B 9/006 52/220.6 |
| 8,038,113 | B2 | 10/2011 | Fryzek et al. | |
| 9,416,535 | B1 | 8/2016 | Yaphe et al. | |
| 9,435,121 | B2 | 9/2016 | Bergman et al. | |
| 9,771,718 | B1 * | 9/2017 | Curtin | E04B 9/067 |
| 10,370,843 | B2 * | 8/2019 | Ting | E04B 1/4107 |
| 10,526,786 | B2 * | 1/2020 | Lukito | E04C 3/04 |
| 2002/0152704 | A1 * | 10/2002 | Thompson | E04B 9/245 52/506.06 |
| 2006/0075710 | A1 * | 4/2006 | Maley | E04B 9/064 52/506.01 |
| 2009/0277117 | A1 * | 11/2009 | Platt | E04B 9/064 52/316 |
| 2013/0047541 | A1 * | 2/2013 | Mayer | E04B 9/247 52/506.05 |
| 2015/0308617 | A1 * | 10/2015 | Sareyka | E04B 9/067 52/506.07 |

* cited by examiner

CEILING SUPPORT SYSTEMS

CROSS REFERENCE TO RELATED APPLICATION

This application claims priority from and the benefit of U.S. Provisional Application Ser. No. 62/517,741, entitled "CEILING GRID DESIGN," filed Jun. 9, 2017, which is hereby incorporated by reference.

BACKGROUND

This application relates generally to heating, ventilation, and air conditioning (HVAC) systems, and more particularly, to ceiling support systems for buildings.

Residential, light commercial, commercial, and industrial systems are used to control temperatures and air quality in buildings. To condition the buildings, HVAC systems may circulate a refrigerant through a closed circuit between an evaporator where the refrigerant absorbs heat and a condenser where the refrigerant releases heat. The refrigerant flowing within the closed circuit is generally formulated to undergo phase changes within the normal operating temperatures and pressures of the HVAC system so that quantities of heat can be exchanged by virtue of the latent heat of vaporization of the refrigerant to provide conditioned air to the buildings.

Certain buildings include suspended or dropped ceilings within conditioned rooms of the buildings. For example, a building may include a framework hanging downward or suspended from a ceiling of the room. Then, panels and lights may be fitted within cells of the framework to enable a HVAC system to condition the room beneath the dropped ceiling. However, the framework may include multiple complex and bulky components that are heavy, costly to manufacture, and difficult to assemble within the building. Additionally, the components may be connectable to one another in limited and specific manners, thereby further complicating an assembly process for the framework. Accordingly, it may be desirable to provide ceiling support systems that are more efficient to assemble and less expensive to manufacture.

SUMMARY

In one embodiment of the present disclosure, a ceiling support system for a dropped ceiling of a building includes a support beam configured to enable modular assembly of the dropped ceiling. The support beam includes a core portion. A length of a face of the core portion extends along a first axis transverse to a length of first and second lateral sides of the core portion, which extends along a second axis. The support beam also includes a base having a base ledge extending from the first lateral side of the core portion. The support beam includes a first hook extension having a first clip ledge extending from the first lateral side of the core portion and a first lip extending from a first distal edge of the first clip ledge. The support beam also includes a second hook extension having a second clip ledge extending from the first lateral side of the core portion and a second lip extending from a second distal edge of the second clip ledge. The first hook extension and the second hook extension are configured to receive a slidable joining clip therebetween.

In another embodiment of the present disclosure, a ceiling support system for a dropped ceiling of a building includes a joining clip having a first clip portion extending at an angle relative to a second clip portion. The ceiling support system also includes a first support beam configured to be coupled to the first clip portion. The first support beam includes a first core portion. A length of a face of the first core portion extends along a first axis transverse to a length of first and second lateral sides of the first core portion, which extends along a second axis. The first support beam includes a first base having a first base ledge extending from the first lateral side of the first core portion. The first support beam also includes a first central retainer extending from the first lateral side of the first core portion and configured to slidably receive the first clip portion. The ceiling support system also includes a second support beam configured to be coupled to the second clip portion. The second support beam includes a second core portion. A length of a face of the second core portion extends along a third axis transverse to a length of third and fourth lateral sides of the second core portion, which extends along a fourth axis. The second support beam includes a second base having a second base ledge extending from the third lateral side of the second core portion. The second support beam also includes a second central retainer extending from the third lateral side of the second core portion and configured to slidably receive the second clip portion.

In a further embodiment of the present disclosure, a ceiling support system for a dropped ceiling of a building includes a first support beam configured to extend along a first axis. The ceiling support system also includes a second support beam configured to extend along a second axis, crosswise to the first axis. The first support beam is configured to be coupled to the second support beam by a slidable joining clip. The first support beam and the second support beam each include a core portion having first and second lateral sides, a base having a base ledge extending from the first lateral side of the core portion, a central clip retainer defined on the first lateral side of the core portion and configured to receive a respective portion of the slidable joining clip, and a distal retainer defined on the core portion and configured to receive a respective slidable top support clip.

Other features and advantages of the present application will be apparent from the following, more detailed description of the embodiments, taken in conjunction with the accompanying drawings which illustrate, by way of example, the principles of the application.

DETAILED DESCRIPTION

Figure 1:
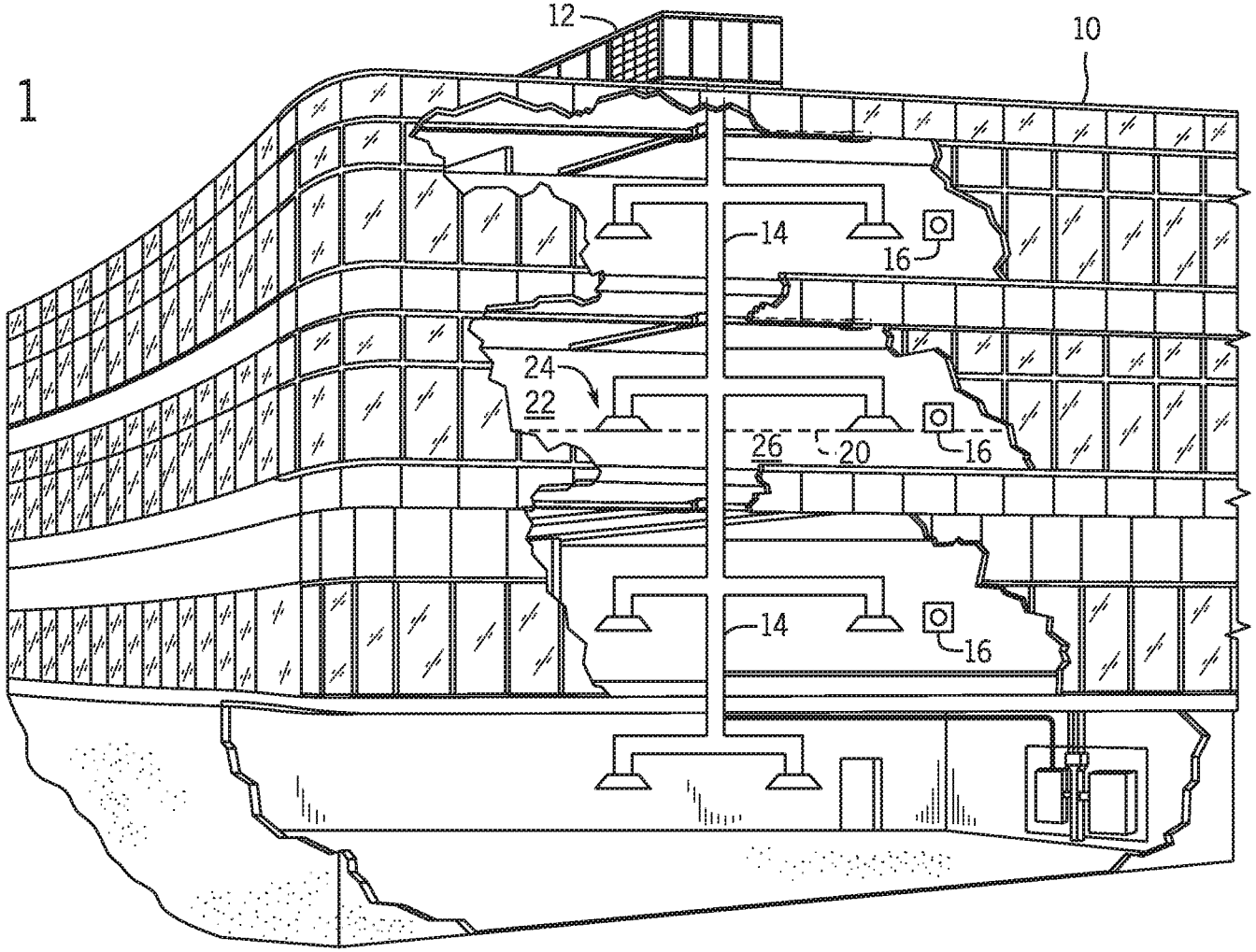
FIG. 1 is an illustration of an embodiment of a building having a commercial or industrial HVAC system, in accordance with the present techniques.

The present disclosure is directed to ceiling support systems for dropped or suspended ceilings for buildings using HVAC systems. For example, a dropped or suspended ceiling may separate an upper portion of a room including HVAC ducts, piping, and wiring from a lower portion of the room, thereby improving an aesthetic perspective or view from the lower portion of the room. Because the room is partitioned into a smaller volume, the lower portion of the room may also be more efficiently conditioned than a room of comparable size without a dropped or suspended ceiling. In general, the dropped ceiling includes a framework suspended from an upper structural surface of the room, such as an inner surface of an outer ceiling of the building or a lower surface of a floor above the room, hereinafter referred to as a ceiling. Then, panels, light fixtures, or other components may be disposed within the framework to provide a separation layer between the upper portion and the lower portion of the room.

The ceiling support system disclosed herein includes support beams, such as main tees, cross tees, and edge brackets, having an improved profile that enables modular assembly of the dropped ceiling for the room. For example, the profile of the support beam may include a base portion and an upright or core portion extending generally vertically, crosswise, or orthogonally from the base portion. The upright portion may include multiple receiving features or retainers for receiving joining clips, sliding clips, support clips, suspension clips, and so forth. For example, two bent or hook extensions may generally extend from a lateral surface of the upright portion and angle toward one another, such that a receiving space or slot is defined along the lateral surface of the upright portion between the two bent extensions. As such, an L-shaped joining clip may be provided and coupled within the receiving space of the support beam and an additional receiving space or slot of an additional support beam, thereby joining the support beam and the additional support beam together at a generally right angle relative to one another. By joining multiple support beams together with multiple joining clips, a cell for receiving a panel, a light, or an air diffuser may be defined for the ceiling support system. The upright portion of the support beam may also include an upper holding space or distal extension for receiving a slidable top support clip. A suitable hanger, such as a wire, a cable, or a rod, may be attached to the slidable top support clip to secure the support beam to the ceiling of the room and to maintain the support beam at a desired height within the room. Moreover, the support beam of the disclosed ceiling support system may include a visual alignment notch for improving assembly and alignment of the ceiling grid, as well as gasket retention lips extending upward from edge portions of the base portion to define a receiving space for a sealing gasket. Although described below with reference to directional modifiers in reference to an installed position or orientation of each component within the ceiling support system, it is to be understood that any other suitable frame of reference may be used to describe the components discussed herein. As discussed in more detail below, a combination of the features introduced above enable the ceiling support system to be efficiency manufactured as well as efficiently and modularly assembled to form a dropped ceiling for any suitable building.

Turning now to the drawings, FIG. 1 illustrates a heating, ventilation, and air conditioning (HVAC) system for building environmental management that may employ one or more HVAC units. In the illustrated embodiment, a building 10 is air conditioned by a system that includes a HVAC unit 12. The building 10 may be a commercial or a residential building. As shown, the HVAC unit 12 is disposed on the roof of the building 10; however, the HVAC unit 12 may be located in other equipment rooms or areas adjacent the building 10. The HVAC unit 12 may be a single packaged unit containing other equipment, such as a blower, integrated air handler, and/or auxiliary heating unit. In other embodiments, the HVAC unit 12 may be part of a split HVAC system.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

It may be desirable to include a suspended or dropped ceiling 20 within the building 10 to improve operation of the HVAC unit 12 and/or an aesthetic appearance of rooms or spaces within the building 10. The dropped ceiling 20 may separate or partition an upper portion 22 of a room 24 of the building 10 from an inhabited or lower portion 26 of the room 24. For example, the dropped ceiling 20 may enclose and shield the ductwork 14, piping, and/or wiring of the building 10 from the lower portion 26 of the room 24. Additionally, the dropped ceiling 20 may reduce a volume of air for the HVAC unit 12 to condition within the room 24, thereby decreasing operating costs for the HVAC unit 12. Although one dropped ceiling 20 is illustrated for the room 24 within the building 10, it is to be understood that more than one dropped ceiling 20 may be included for any suitable room or space of the building 10, for each floor or level of the building 10, and so forth. Moreover, the dropped ceiling 20 may be supported by a ceiling support system that may be more efficiently manufactured and assembled than large and heavy traditional ceiling systems, as described in more detail below.

Figure 2:
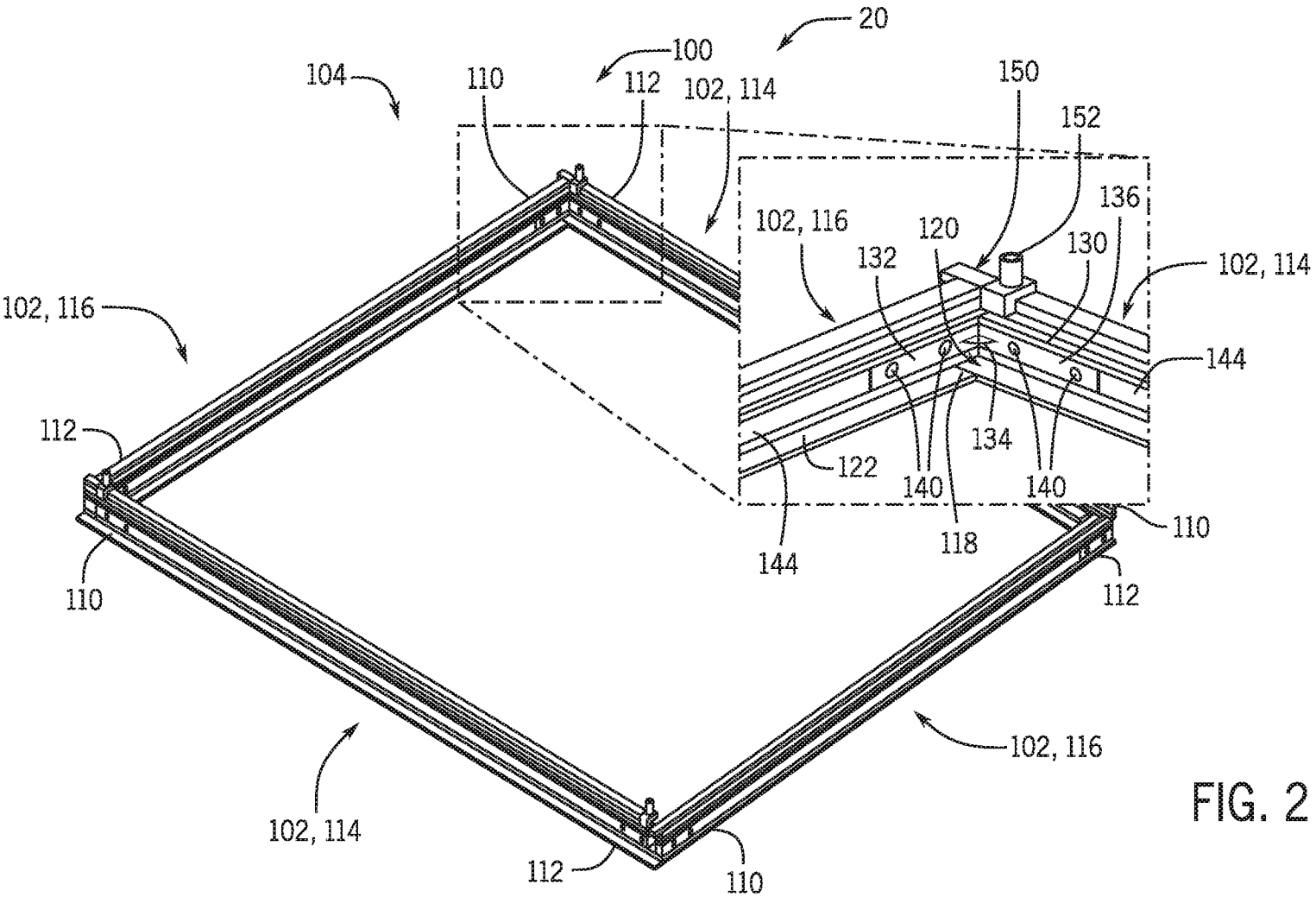
FIG. 2 is a perspective view of an embodiment of a ceiling support system for the building of FIG. 1, in accordance with the present techniques.

FIG. 2 is a perspective view illustrating an embodiment of a ceiling support system 100 for providing the dropped ceiling 20. The illustrated embodiment of the ceiling support system 100 includes four support beams 102 coupled to one another to form a cell 104 or modular element of the dropped ceiling 20. That is, a first end portion 110 of each support beam 102 is coupled to a second end portion 112 of an adjacent support beam 102. In the present embodiment, two of the support beams 102 are main tees 114 and two of the support beams 102 are cross tees 116 that are coupled between the main tees 114. In some embodiments, the main tees 114 are designed to extend along a full length or width of the dropped ceiling 20, while the cross tees 116 are designed to extend between generally parallel main tees 114. As such, in some embodiments, multiple main tees 114 may be coupled together end-to-end to extend along the full width or length of the room 24 and may therefore have a longer assembled length than a length of the cross tees 116. However, in some embodiments, multiple cells 104 of the dropped ceiling 20 having four similarly sized support beams 102 may be duplicated and coupled together to form a desired length and width for the dropped ceiling 20.

To enable the cross tees 116 to fit closely with the main tees 114, a base notch 118, notched receiving portion, or cutout may be formed in the base portion 122 of each end portion 110, 112 of the cross tees 116. Then, a protruding portion 120 or un-notched corner of the base portion 122 of the adjacent main tees 114 may extend within the base notch 118. As such, a joining clip 130 or L-shaped joining clip may be reversibly and adjustably fit between adjacent support beams 102 to couple the support beams 102 together. The joining clip 130 may be a bent or angular element having an L-shaped profile. That is, a first portion 132 of the joining clip 130 may be disposed at an angle 134, such as approximately 90 degrees, relative to a second portion 136 of the joining clip 130. As noted herein, the angle 134 of approximately 90 degrees may refer to angles that are between 75 degrees and 105 degrees, between 60 degrees and 120 degrees, and so forth. Additionally, two apertures 140 are defined within each portion 132, 136 of the joining clip 130. As such, push nuts or other suitable fasteners may be disposed through the apertures 140 to press into a lateral surface 144 or lateral side of the support beams 102. However, any suitable number of apertures may be defined within the joining clip 130, or self-tapping screws may be used to form the apertures 140 within the joining clip 130 during assembly. To vertically restrain the joining clip 130, the support beams 102 may include a central receiving feature having bent axial extensions that extend from the lateral surface 144 of the support beams 102 and lap over the joining clip 130, as described in more detail below.

The support beams 102 may also include other features to enable efficient and effective assembly of the ceiling support system 100. For example, a top receiving feature 150 or top plate of the support beams 102 may receive various clips thereon, such as a top support clip 152 for suspending the ceiling support system 100 from a ceiling of the building 10. Indeed, a hanger, such as wire, cable, rod, or so forth, may be coupled between the top support clip 152 and the ceiling of the room 24 in which the dropped ceiling 20 is installed. In some embodiments, other suitable clips, brackets, or elements, such as those for coupling devices within the ceiling support system 100, may also be disposed on the top receiving feature 150 of the support beams 102.

In general, to install the dropped ceiling 20 having the ceiling support system 100, a L-shaped perimeter or wall molding may be installed at a desired height along walls of the room 24. The wall molding may correspond to a half or bisection of the support beams 102 illustrated in FIG. 2, such as the edge support beams discussed in more detail with reference to FIG. 3. That is, the wall molding may include a base portion and an upright portion extending therefrom having retaining features that extend from one lateral surface of the upright portion, while an opposed surface of the upright portion includes a flat surface for placing the wall molding against the walls of the room 24. After coupling the wall molding around the perimeter of the room 24, the main tees 114 may be coupled end-to-end and extended from one end of the room 24 to an opposed end of the room 24. The main tees 114 may also be suspended from the ceiling of the room 24 by the hangers coupled to the top support clips 152. Because the top support clips 152 may slide along the top receiving feature 150 of the main tees 114, the disclosed ceiling support system 100 provides a reduced demand for providing specific dimensions for assembling the dropped ceiling 20. In some embodiments, the top support clips 152 may be disposed along the main tees 114 every 4 feet (1.22 m) or less.

Then, the cross tees 116 having the notches 118 in the base portions 122 may be coupled between the main tees 114. In this manner, multiple cells 104 for receiving or engaging with cellular elements such as the panels or lights may be formed between the support beams 102. In some embodiments, the cell 104 may be duplicated or reproduced with additional support beams 102 and joining clips 130 to form a modular or continuously adjustable assembly of the ceiling support system 100. Indeed, four joining clips 130 may be employed to couple together four support beams 102 to create an X-shaped joint or element. Multiple X-shaped joints may therefore be connected at their ends to span a desired space of for the dropped ceiling 20.

Figure 3:
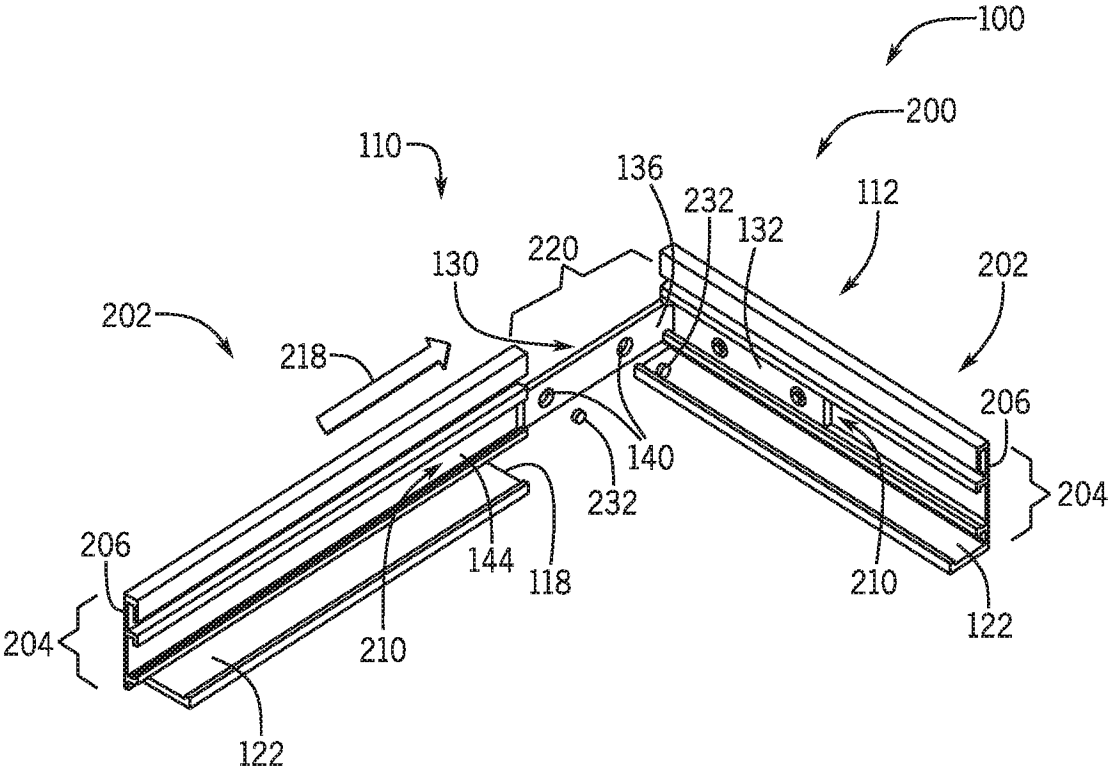
FIG. 3 is a perspective view of an embodiment of a partial connection between support beams of the ceiling support system of FIG. 1, in accordance with the present techniques.

FIG. 3 is a perspective view of an embodiment of the ceiling support system 100 including a partial connection 200 between two edge support beams 202 or edge brackets. The edge support beams 202 may be lateral bisections of the support beams 102 described above, such that the edge support beams 202 may be disposed flush or adjacent to a wall, edge, or corner of the room 24 of the building 10. In other words, the edge support beams 202 may not include attachment features on both lateral surfaces of an upright portion 204 or core portion extending perpendicularly or crosswise from the base portion 122 of the edge support beams 202. Instead, the edge support beams 202 may each include a flat, generally vertical surface 206. In some embodiments, the edge support beams 202 correspond to the wall molding to be disposed around a perimeter of the room 24 that enables additional support beams 102 to be assembled within the room 24, as described above.

To couple the edge support beams 202 coupled together, the ceiling support system 100 includes the joining clip 130. As illustrated, the first portion 132 of the joining clip 130 is coupled within a receiving space 210 or slot of one of the edge support beams 202 and the second portion 136 of the joining clip 130 is partially disposed within the receiving space 210 or slot of the other edge support beam 202. To assemble the second portion 136 of the joining clip 130 within the other edge support beam 202, a technician may slide the second edge support beam 202 along a movement direction 218, such that an exposed length 220 of the second portion 136 of the joining clip 130 moves within the receiving space 210 of the second edge support beam 202 to a target or assembled position. Because the base portion 122 of the edge support beam 202 includes the base notch 118, the end portions 110, 112 of the edge support beams 202 may be moved together such that the base notch 118 of the base portion 122 mates with the protruding portion 120 of the base portion 122 of the other edge support beam 202.

Then, the second portion 136 of the joining clip 130 may be fastened to the lateral surface 144 of the upright portion 204 of the other edge support beam 202. For example, push nuts 232 or any other suitable fastener may be disposed through the apertures 140 within the joining clip 130 to bite or extend into the lateral surface 144 of the upright portion 204 of the edge support beam 202. Indeed, although discussed with reference to extending fasteners through predefined apertures in the joining clip 130, it is to be understood that the ceiling support system 100 include any appropriate components for the selected fastener, such that, for example, self-tapping screws may be used to define respective apertures through the joining clip 130 during installation of the ceiling support system 100. As such, the partial connection 200 of the ceiling support system 100 may be assembled or completed effectively with a reduced reliance on tools, such that a joint similar to the joints illustrated in FIG. 2 is formed.

Figure 4:
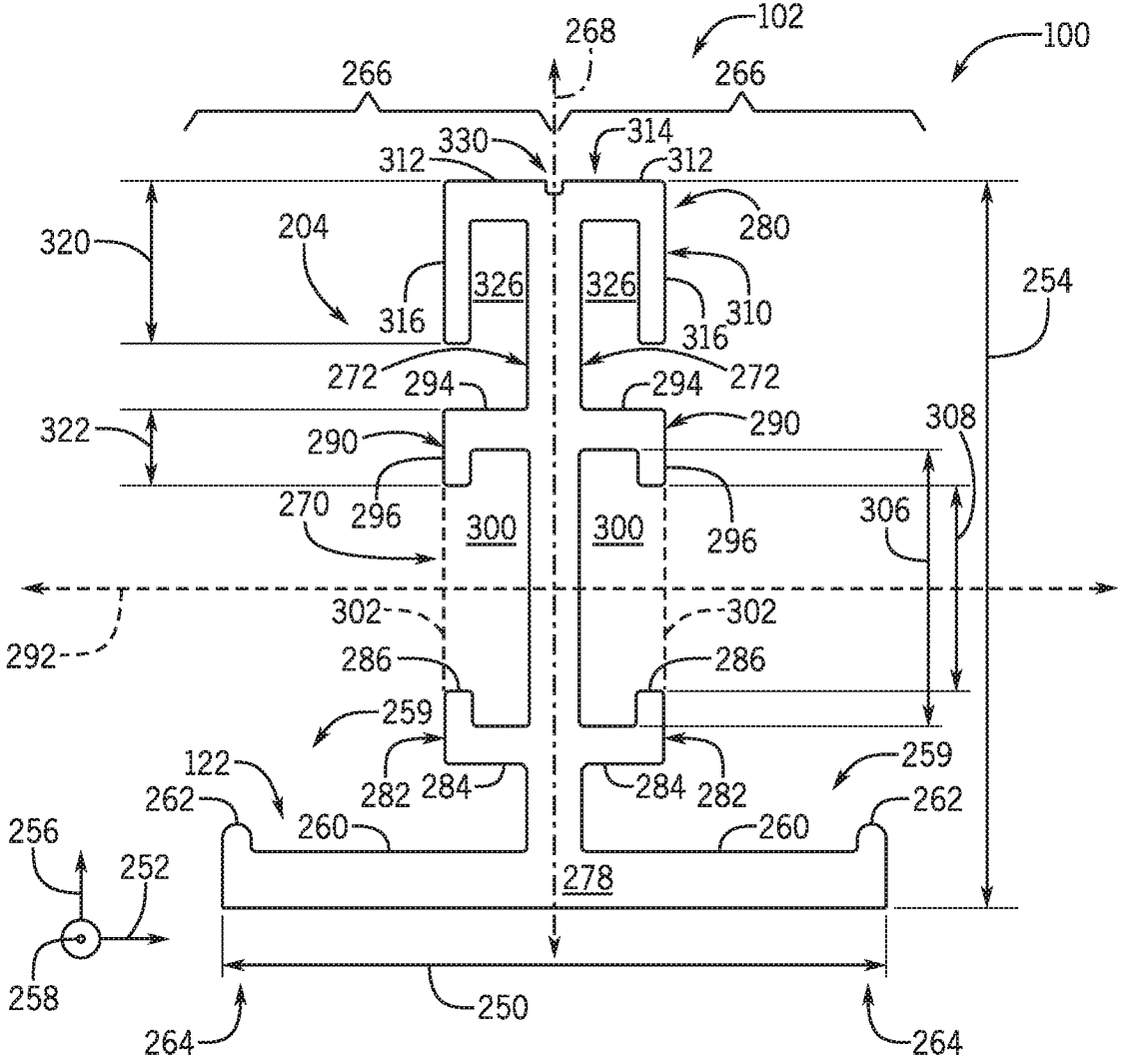
FIG. 4 is a cross-sectional axial view of an embodiment of a support beam of the ceiling support system of FIG. 2, in accordance with the present techniques.

FIG. 4 is a cross-sectional axial view of an embodiment of the support beam 102 of FIG. 2. As illustrated, the support beam 102 includes a width 250 extending or defined along an x-axis 252, a height 254 extending or defined along a y-axis 256, and a length extending or defined along a z-axis 258. Each axis may be generally transverse, crosswise, or orthogonal to the other axes. The support beam 102 may include the base portion 122, base, or extension that generally corresponds to or defines the width 250 of the support beam 102. Additionally, the support beam 102 may include the upright portion 204, core portion, or extension that generally corresponds to or defines the height 254 of the support beam 102. As such, the base portion 122 and the upright portion 204 cooperatively defined a T-shaped cross section of the support beam 102. Further, a face 278 of the support beam 102 may be defined at each longitudinal end of the support beam 102, which may resemble the illustrated cross-sectional axial view, in some embodiments. Thus, the height 254 of the support beam 102 may correspond to a length or main dimension of the face 278. Moreover, as used herein, directional modifiers, such as vertical, horizontal, upper, lower, and so forth, are described in reference to an installed position or orientation of each component within the ceiling support system 100.

The upright portion 204 may be integrally formed with the base portion 122, such as by a metal extrusion process. However, in other embodiments, the base portion 122 and the upright portion 204 of the support beam 102 may be coupled together via welding or another suitable process after the base portion 122 and the upright portion 204 are formed or manufactured separately. The support beam 102 is illustrated as having two generally symmetrical portions 266 that may be mirror images of one another across a plane defined between the y-axis 256 and the z-axis 258. However, in embodiments in which the support beam 102 is to be disposed at an edge or a corner of a room within the building 10, the support beam 102 may be the edge support beam 202 discussed above that is manufactured without one of the symmetrical portions 266, such that the edge support beam 202 includes a generally L-shaped cross section in a plane defined between the y-axis 256 and the x-axis 252.

Looking to the features of the base portion 122, the base portion 122 may generally include a base ledge 259 extending from each lateral surface 272 of the upright portion 204. Additionally, the base portion 122 includes a flat upper surface 260, gasket recess, or receiving space on each side of the upright portion 204 for receiving a gasket or sealing member thereon. During assembly of the dropped ceiling 20, a gasket may be aligned along each flat upper surface 260 of the base portion 122, and then a lower surface of a ceiling panel may be disposed on an upper surface of each gasket. The gaskets may therefore create a hermetic or airtight seal between the upper portion 22 and the lower portion 26 of the room 24 having the dropped ceiling 20. Moreover, the illustrated base portion 122 includes gasket retention lips 262, gasket alignment lips, or raised lips at lateral edge portions 264 or distal edges of the base portion 122. As used herein, lateral portions are defined with respect to the x-axis 252, such that laterally inward elements are closer to a generally vertically-extending centerline 268 or axial centerline of the support beam 102 along the x-axis 252 than laterally outward surfaces. The gasket retention lips 262 define a lateral end or distal end of the flat upper surface 260 of the base portion 122. As such, technicians that are assembling the ceiling support system 100 may more efficiently and uniformly align the gaskets on the flat upper surface 260 of the support beam 102 compared to traditional tees without the illustrated gasket retention lips 262.

The upright portion 204 of the support beam 102 includes multiple features or extensions that facilitate connection of the support beams 102 together, as well as attachment of clips or other elements to the support beams 102. For example, a central feature 270 or central clip retainer defined on each lateral surface 272 or lateral side of the upright portion 204 may receive one of the joining clips 130, while a top feature 280, distal extension, clip retainer, or upper feature may receive other elements of the ceiling support system 100. As noted herein, the lateral surfaces 272 extend along the length of the support beam 102, which extends along the z-axis 258. As illustrated, the central features 270 include upward-facing hook extensions 282 that protrude from the lateral surfaces 272 of the upright portion 204, vertically spaced from the base portion 122. The upward-facing hook extensions 282 each include a flat portion 284 or clip ledge that angles or transitions upward into a vertical portion 286 or lip. The illustrated vertical portions 286 are each angled away from the flat portion 284 by 90 degrees, although any other suitable angle may be employed by the support beam of the ceiling support system 100.

Vertically spaced from the upward-facing hook extensions 282, the central feature 270 may also include inner downward-facing hook extensions 290 that may protrude from the lateral surfaces 272. The inner downward-facing hook extensions 290 may be mirror images of the upward-facing hook extensions 282 across a reflection line 292, in some embodiments. That is, the inner downward-facing hook extensions 290 may each include a flat portion 294 or clip ledge that angles or transitions downward into a vertical portion 296 or lip. As such, the central feature 270 of the upright portion 204 of the support beam 102 defines a receiving space 300 or slot for receiving a portion of a joining clip 130 therein. The illustrated receiving space 300 includes an open vertical surface 302 so that the push nuts or other suitable fasteners may be readily coupled to an exposed surface of the joining clip 130, when disposed within the receiving space 300. As such, the receiving space 300 includes a receiving height 306 that is greater than an open vertical height 308 of the open vertical surface 302 in some embodiments, such that the joining clip 130 may be restrained within the receiving space 300 from movement along the x-axis 252.

Additionally, the top feature 280 of the upright portion 204 of the support beam 102 includes upper downward-facing hook extensions 310 that are vertically spaced from the inner downward-facing hook extensions 290. The illustrated upper downward-facing hook extensions 310 include flat portions 312 that define an upper surface 314 or distal surface of the support beam 102. The flat portions 312 may angle or transition downward into long vertical portions 316 or lips that extend along the y-axis 256. A length 320 of the long vertical portions 316 of the upper downward-facing hook extensions 310 may be longer than a length 322 of the vertical portion 296 of the inner downward-facing hook extensions 290 in some embodiments. The upper downward-facing hook extensions 310 may each define an upper receiving space 326 that enables the support beam 102 to receive clips therein, as described with reference to additional figures below.

As illustrated, the flat portions 312 of the upper downward-facing hook extensions 310 of the top feature 280 are separated by an alignment notch 330 or visual alignment notch. The alignment notch 330 may be a recess or channel formed along the length of the support beam 102 to indicate the vertically-extending centerline 268 of the support beam 102. In some embodiments, the alignment notch 330 is formed during extrusion or initial production of the support beam 102, though any other suitable forming process, such as carving or engraving of the alignment notch 330, may also be used. The alignment notch 330 improves assembly of the ceiling support system 100 by enabling a technician to rapidly and effectively identify the vertically-extending centerline 268 of the support beam 102. Therefore, the technician may align multiple support beams 102 or components to the vertically-extending centerline 268 without auxiliary measurement tools and/or without estimation. In some embodiments, the alignment notch 330 may be raised relative to, instead of recessed into, the upper surface 314 of the support beam 102. Moreover, in some embodiments, the alignment notch 330 may be a colored or otherwise visible line disposed onto upper surface 314 of the support beam 102, such as a line formed by chalk, paint, ink, and so forth.

Figure 5:
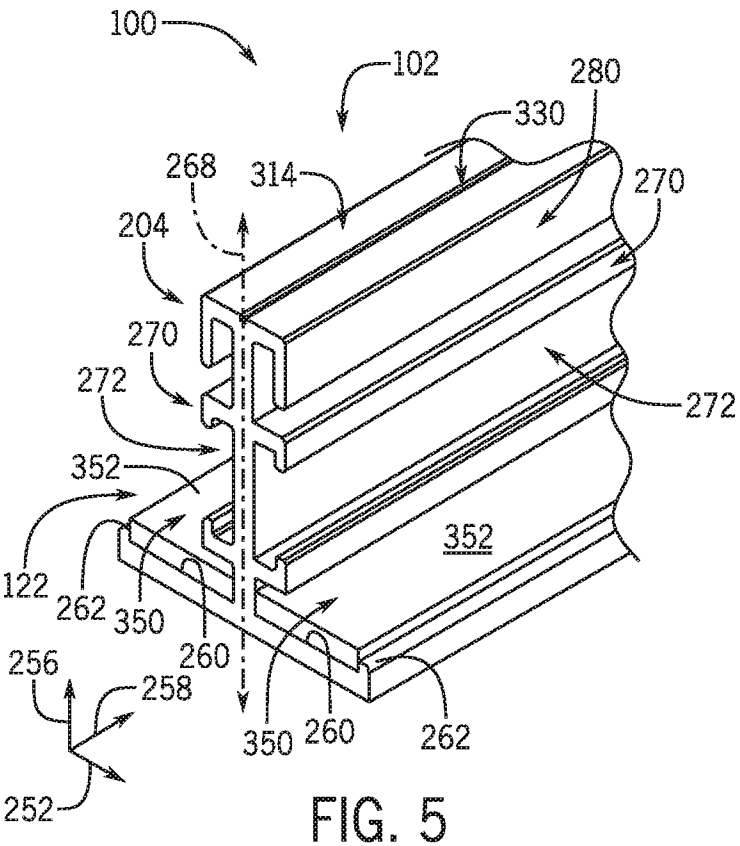
FIG. 5 is a perspective view of an embodiment of gaskets disposed on the support beam of FIG. 4, in accordance with the present techniques.

FIG. 5 is a perspective view of an embodiment of the support beam 102 of the ceiling support system 100 having gaskets 350 aligned thereon. That is, the gaskets 350 are disposed along the flat upper surfaces 260 or receiving spaces of the base portion 122 of the support beam 102, between the gasket retention lips 262 and the upright portion 204 of the support beam 102. Indeed, the gasket retention lips 262 enable technicians to efficiently identify a target position of the gaskets 350, thus reducing gasket overhang or misalignment that traditional ceiling systems may experience. Therefore, the gaskets 350 may be aligned along the flat upper surfaces 260 more uniformly and efficiently than on support beams without gasket alignment retention lips. As such, an upper gasket surface 352 of each gasket 350 is capable of receiving and sealing against a lower surface of a ceiling element, such as a panel or light element. In some embodiments, each gasket 350 is manufactured with adhesive on a lower surface 354 of the gasket 350 to resist movement during operation of the ceiling support system 100. The gaskets 350 may be disposed on or attached to the support beam 102 within a manufacturing facility or in situ by a technician installing the ceiling support system 100 within the building 10. The gaskets 350 may be any suitable resilient material, such as foam, rubber, plastic, and so forth. As such, the gaskets 350 enable the dropped ceiling 20 having the ceiling support system 100 to seal or hermetically seal the upper portion 22 of the room 24 from the lower portion 26 of the room.

In the present embodiment, the support beam 102 also includes the alignment notch 330 extending along the upper surface 314 of the support beam 102 along the z-axis 258 to enable technicians to identify the vertically-extending centerline 268 of the support beam 102 more efficiently than for support beams without an alignment notch. The support beam 102 additionally includes the top feature 280 for receiving attachment clips and the central feature 270 for receiving joining clips 130 on both lateral surfaces 272 of the upright portion 204 of the support beam 102. With the illustrated combination of features, the illustrated ceiling support system 100 having the support beam 102 may be assembled efficiently with a reduced amount of tools as compared to traditional ceiling systems.

Figure 6:
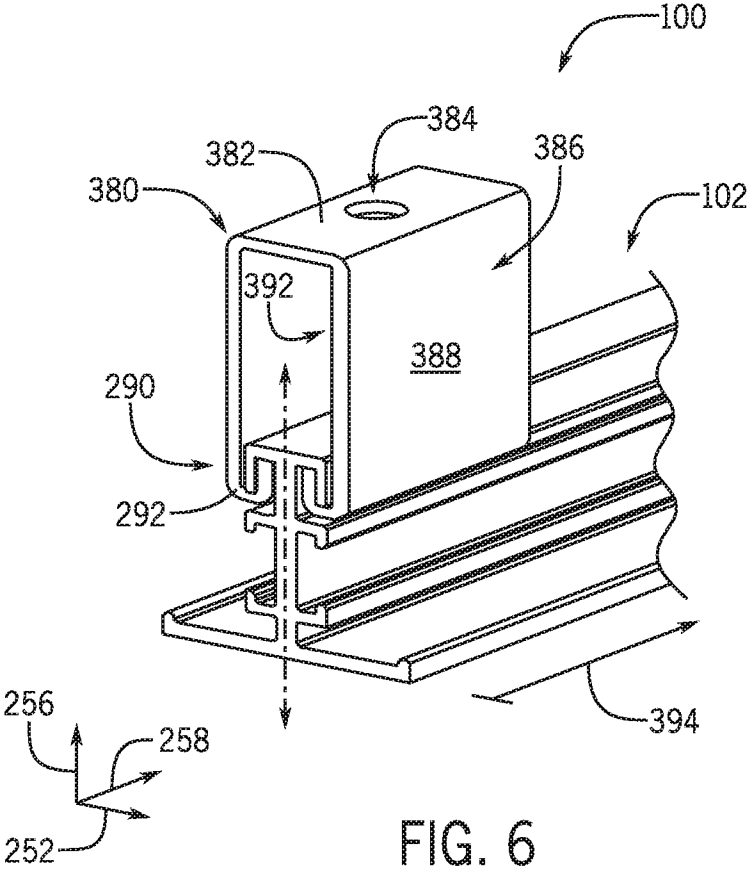
FIG. 6 is a perspective view of an embodiment of a top support clip disposed on the support beam of FIG. 4, in accordance with the present techniques.

FIG. 6 is a perspective view of an embodiment of the ceiling support system 100 having a top support clip 380 disposed on the support beam 102. The top support clip 380 may be a single element folded into the illustrated shape, or may be multiple elements attached together. For example, the top support clip 380 may include a top portion 382 having an aperture 384 or opening defined therethrough. From the top portion 382, the top support clip 380 may extend down along the y-axis 256 into lateral portions 386. The lateral portions 386 may generally define a flat surface 388 extending in a plane defined between the y-axis 256 and the z-axis 258. At bottom portions 390 of the top support clip 380, the top support clip 380 includes hook ends 391 that curl inward toward the vertically-extending centerline 268 of the support beam 102 from the lateral portions 386 of the top support clip 380. The hook ends 391 may generally include a U-shaped profile that enable the hook ends 391 to be received within the upper downward-facing hook extensions 310 of the top feature 280 of the support beam 102. In this manner, the top support clip 380 may be slid or moved to any suitable position along a length 394 of the support beam 102. Additionally, the top support clip 380 may define a hollow space 392 between the lateral portions 386 that enable a user to more easily couple elements through the aperture 384 and/or the top support clip 380.

To couple the ceiling support system 100 to the ceiling of the room 24, a technician may dispose the support beam 102 at a desired height within the room 24, such as within the framework including the main tees 114 and the cross tees 116 discussed above, and then connect the top support clip 380 to the ceiling of the room 24. As such, the top support clip 380 provides a supporting force that enables the ceiling support system 100 to be suspended below the ceiling. Along the structural elements that define the complete ceiling support system 100 forming the dropped ceiling 20, any suitable number of top support clips 380 may be included, such as one per support beam 102, one per 4 feet (1.22 m) of length of the support beam 102, and so forth. Moreover, because the top support clips 380 may be continually adjusted along the length 394 of the support beam 102, the ceiling support system 100 may be adapted to various features or shapes of the room 24. For example, in embodiments in which the ceiling support system 100 is replacing a previously installed system, the position of the top support clips 380 along the support beams 102 may be modularly adjusted to be positioned below preexisting hangers. In this manner, an existing hanger may be threaded through the aperture 384, coupled to an element, such as a bolt attached through the aperture 384, and so forth. The hangers may extend from the top support clip 380 to the ceiling, where they are attached to the ceiling with screw eyes, screw hooks, nails, or any other suitable attachments.

Figure 7:
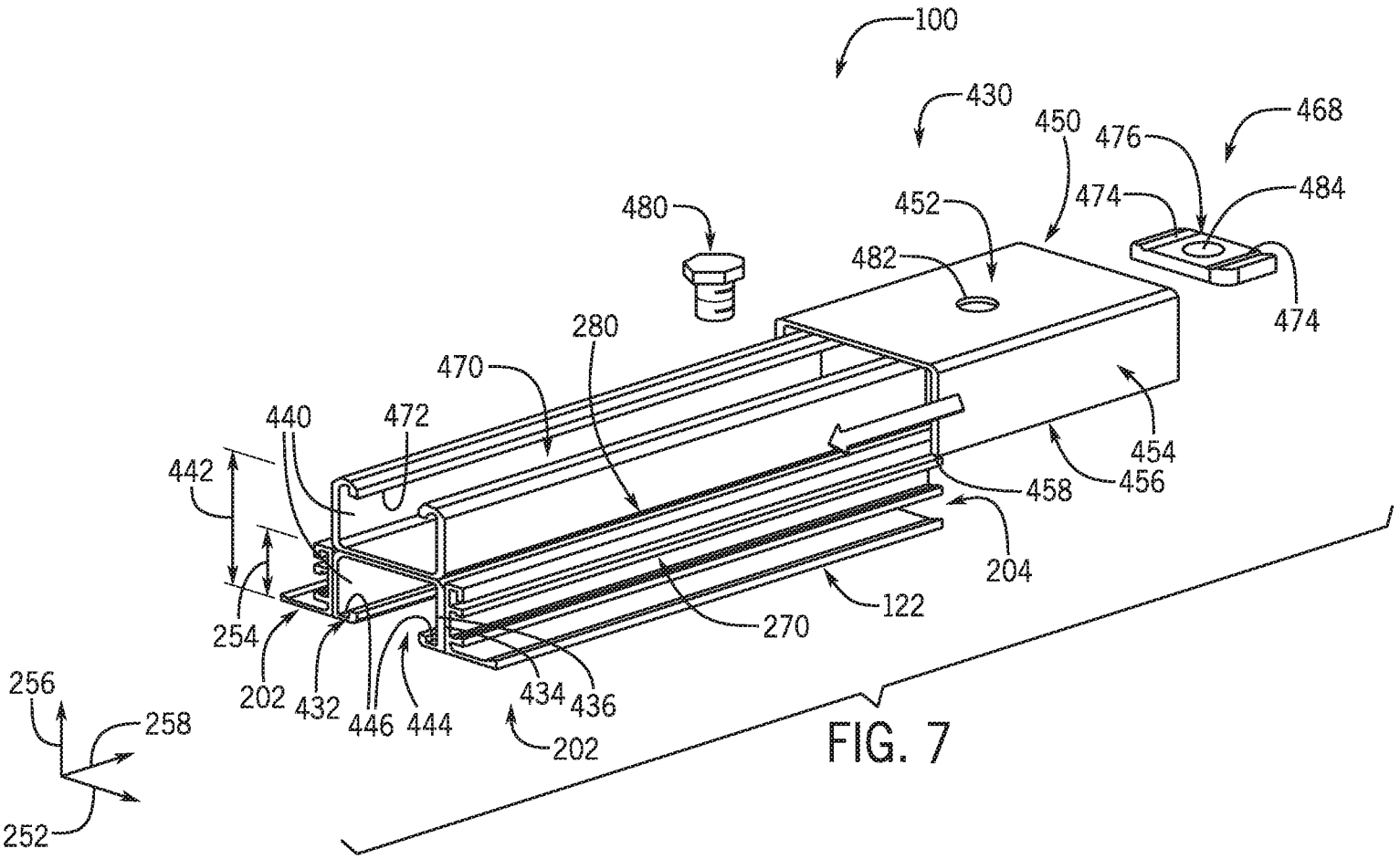
FIG. 7 is a perspective view of an embodiment of a unistrut system of the ceiling support system of FIG. 1, in accordance with the present techniques.

FIG. 7 is a perspective view of a unistrut system 430 of the ceiling support system 100. The unistrut system 430 may be used to support various equipment above a working space in the building 10, such as electrical equipment, mechanical equipment, lights, acoustic and/or decorative panels, walkways, and so forth. As such, the unistrut system 430 includes a main support member 432 disposed between two edge support beams 202, such as the edge support beams 202 discussed above with reference to FIG. 3. The main support member 432 may be designed to support a large load or weight, and therefore may be formed of steel or another strong material. As illustrated, each edge support beam 202 includes the base portion 122 and the upright portion 204 extending therefrom, such that an L-shaped profile is visible when viewing the ceiling support system 100 along the z-axis 258. Each edge support beam 202 includes a flat surface 434 in contact with an outer surface 436 of the main support member 432. Additionally, each edge support beam 202 includes the top feature 280 or distal extension and one central feature 270 or central retainer for retaining clips thereon, as described above.

In the present embodiment, the main support member 432 includes two beams 440 arranged back to back, which may be coupled together by bolts, screws, welding, or any other suitable attachment device or process. In some embodiments, the height 254 of the edge support beams 202 may be shorter than a main beam height 442 of the main support member 432. However, it is to be understood that any suitable main support member having any suitable dimensions, such as a single beam element, may be used by the techniques disclosed herein. Further, the main support member 432 defines an open space or channel 444 within a lower one of the beams 440, with holding ledges 446 therein, such that certain equipment may be suspended over the floor of the building 10 and slid within the channel 444.

The edge support beam 202 may be retained against the outer surfaces 436 of the main support member 432 by any suitable device or process. For example, in the present embodiment, a unistrut clip 450 is included within the unistrut system 430 to retain the edge support beams 202 to the main support member 432. The unistrut clip 450 may generally correspond to the top support clip 380 of FIG. 6, such that the unistrut clip 450 also includes a top portion 452, lateral portions 454, and bottom portions 456 having hook ends 458. The hook ends 458 of the unistrut clip 450 may be disposed within the top feature 280 of the edge support beams 202. Moreover, the hook ends 458 of the unistrut clip 450 may enable the unistrut clip 450 to slide or move within the top feature 280 of the edge support beams 202 to enable adaptive attachment of the ceiling support system 100 to hangers within the building 10.

To block or restrict movement of the edge support beams 202 relative to the main support member 432, the main support member 432 may also be coupled to the unistrut clip 450, such as to the top portion 452 thereof. For example, a receiving plate 468 may be disposed within a hollow portion 470 of the main support member 432, underneath hook ends 472 of the main support member 432. The receiving plate 468 may be a generally rectangular or planar element having channels 474 spaced along a top surface 476 of the receiving plate 468, such that the channels 474 may rest against the hook ends 472 of the main support member 432. Then, a bolt 480 or fastener may be extended through an aperture 482 of the top portion 452 of the unistrut clip 450 and through a corresponding aperture 484 of the receiving plate 468. In this manner, the bolt 480 may retain the main support member 432 between the unistrut clip 450 and the receiving plate 468, such that the main support member 432 is efficiently locked to the unistrut clip 450. The ceiling support system 100 may therefore be adapted for the unistrut system 430 or any other suitable unistrut system to enable modular and efficient assembly of a desired dropped or suspended ceiling.

Accordingly, the present disclosure is directed to a ceiling support system for providing a modular and efficient-to-assemble dropped or suspended ceiling. A support beam or building block of the ceiling support system may include multiple retaining and alignment features to improve assembly of the ceiling support system. For example, a base portion of the support beam may include a gasket retention lip protruding from a lateral end of a flat upper surface of the base portion, such that gaskets may be efficiently assembled on the flat upper surface between the gasket retention lip and an upright portion of the support beam that extends from the base portion. Additionally, the upright portion of the support beam may include a central feature having two centrally-facing hook extensions that partially surround a receiving space for joining clips. By disposing a joining clip within the central feature of the support beam and an additional central feature of another support beam, an L-shaped joint may be formed. The upright portion of the support beam may also include a top feature or distal retainer having downward-facing hook extensions for receiving a slidable support clip thereon. Moreover, a visual alignment notch may facilitate rapid determination of a centerline of the support beam, such that reliance on measuring devices during assembly of the ceiling support system may be reduced compared to traditional tees without the visual alignment notch. The ceiling support system may also be extended to unistrut systems in some embodiments, thus providing a modular assembly for forming dropped ceilings.

While only certain features and embodiments of the present disclosure have been illustrated and described, many modifications and changes may occur to those skilled in the art, such as variations in sizes, dimensions, structures, shapes and proportions of the various elements, values of parameters, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A ceiling support system for a dropped ceiling of a building, comprising:

a support beam configured to enable modular assembly of the dropped ceiling, wherein the support beam comprises:

a core portion, wherein a length of a face of the core portion extends along a first axis transverse to a length of first and second lateral sides of the core portion, which extends along a second axis;

a base comprising a base ledge extending from the first lateral side of the core portion;

a first hook extension comprising a first clip ledge extending from the first lateral side of the core portion and a first lip extending from a first distal edge of the first clip ledge; and a second hook extension comprising a second clip ledge extending from the first lateral side of the core portion and a second lip extending from a second distal edge of the second clip ledge, wherein the first hook extension and the second hook extension are configured to receive a slidable joining clip therebetween.

2. The ceiling support system of claim 1, wherein the first lip of the first hook extension extends along the first axis and toward the second hook extension.

3. The ceiling support system of claim 1, wherein the second lip of the second hook extension extends along the first axis and toward the first hook extension.

4. The ceiling support system of claim 1, wherein the first hook extension and the second hook extension partially enclose a receiving space for receiving the slidable joining clip.

5. The ceiling support system of claim 4, comprising the slidable joining clip, wherein the slidable joining clip comprises a first portion extending at a bent angle relative to a second portion, and wherein the first portion of the slidable joining clip is configured to be retained between the first hook extension and the second hook extension.

6. The ceiling support system of claim 5, wherein the slidable joining clip comprises apertures extending through the first portion, and wherein the slidable joining clip is configured to be reversibly coupled to the support beam via fasteners disposed through the apertures and into the first lateral side of the support beam.

7. The ceiling support system of claim 5, wherein the support beam comprises a cross tee, and wherein the ceiling support system further comprises a main tee comprising:

a main core portion;

a third hook extension comprising a third clip ledge extending from a third lateral side of the main core portion and a third lip extending from a third distal edge of the third clip ledge; and a fourth hook extension comprising a fourth clip ledge extending from the third lateral side of the main core portion and a fourth lip extending from a fourth distal edge of the fourth clip ledge, and wherein the third hook extension and the fourth hook extension are configured to retain the second portion of the slidable joining clip.

8. The ceiling support system of claim 1, wherein a distal surface of the core portion of the support beam comprises an alignment notch extending along the length of the first and second lateral sides of the support beam, and wherein the alignment notch is aligned with a vertical, axial centerline of the support beam.

9. The ceiling support system of claim 1, wherein the base comprises a raised gasket lip extending from a distal edge of the base ledge, and wherein a recess is defined between the raised gasket lip and the core portion.

10. The ceiling support system of claim 9, comprising a gasket configured to be aligned in the recess, wherein the gasket comprises a first surface configured to engage with the recess and a second surface configured to engage with a surface of a cellular element comprising a panel or a light fixture.

11. The ceiling support system of claim 1, wherein the support beam comprises a first support beam, and the base comprises a first base having a first base ledge, and wherein the first base ledge comprises a notch formed in a longitudinal end of the first support beam that is configured to receive a second base ledge of a second base of a second support beam.

12. The ceiling support system of claim 1, wherein the support beam comprises a main tee or a cross tee of the ceiling support system.

13. The ceiling support system of claim 1, wherein the core portion of the support beam extends from a lateral end of the base, and wherein the second lateral side of the core portion comprises a flat surface configured to be retained against a strut of a strut system of the ceiling support system.

14. A ceiling support system for a dropped ceiling of a building, comprising:

a joining clip comprising a first clip portion extending at an angle relative to a second clip portion;

a first support beam configured to be coupled to the first clip portion, comprising:

a first core portion, wherein a length of a face of the first core portion extends along a first axis transverse to a length of first and second lateral sides of the first core portion, which extends along a second axis;

a first base comprising a first base ledge extending from the first lateral side of the first core portion; and a first central retainer extending from the first lateral side of the first core portion and configured to slidably receive the first clip portion; and a second support beam configured to be coupled to the second clip portion, comprising:

a second core portion, wherein a length of a face of the second core portion extends along a third axis transverse to a length of third and fourth lateral sides of the second core portion, which extends along a fourth axis;

a second base comprising a second base ledge extending from the third lateral side of the second core portion; and a second central retainer extending from the third lateral side of the second core portion and configured to slidably receive the second clip portion.

15. The ceiling support system of claim 14, wherein the first support beam comprises a main tee of the ceiling support system, and the second support beam comprises a cross tee of the ceiling support system.

16. The ceiling support system of claim 14, wherein the first base ledge comprises a notched receiving portion configured to receive a protruding portion of the second base ledge.

17. The ceiling support system of claim 14, wherein the first central retainer comprises a downward-facing hook extension extending from the first lateral side of the first core portion and an upward-facing hook extension extending from the first lateral side of the first core portion, and wherein the downward-facing hook extension and the upward-facing hook extension partially enclose a slot configured to receive the first clip portion.

18. The ceiling support system of claim 14, wherein the first core portion of the first support beam comprises a distal retainer configured to receive a sliding support clip therein, wherein the distal retainer comprises a first downward-facing hook extension extending from the first lateral side of the first core portion and a second downward-facing hook extension extending from the second lateral side of the first core portion, and wherein the first downward-facing hook extension and the second downward-facing hook extension each define a support clip receiving slot configured to receive a portion of the sliding support clip.

19. The ceiling support system of claim 14, wherein the first base ledge comprises a gasket alignment lip configured to define a gasket recess between the first core portion and the gasket alignment lip.

20. A ceiling support system for a dropped ceiling of a building, comprising:

a first support beam configured to extend along a first axis; and a second support beam configured to extend along a second axis, crosswise to the first axis, wherein the first support beam is configured to be coupled to the second support beam by a slidable joining clip, and wherein the first support beam and the second support beam each comprise a core portion having first and second lateral sides, a base comprising a base ledge extending from the first lateral side of the core portion, a central clip retainer defined on the first lateral side of the core portion and configured to receive a respective portion of the slidable joining clip, and a distal retainer defined on the core portion and comprising hook end portions configured to receive clip hook end portions of a respective slidable top support clip.

21. The ceiling support system of claim 20, comprising the respective slidable top support clip configured to be coupled to the first support beam, wherein the respective slidable top support clip comprises the clip hook end portions configured to interface with the hook end portions of the distal retainer of the first support beam, and wherein the respective slidable top support clip is configured to couple the first support beam to a hanger attached to a ceiling of the building.

22. The ceiling support system of claim 20, wherein the first support beam and the second support beam each comprise a gasket alignment lip extending from the base ledge, and wherein the ceiling support system comprises a first gasket disposed between the gasket alignment lip and the core portion of the first support beam and a second gasket disposed between the gasket alignment lip and the core portion of the second support beam.

23. The ceiling support system of claim 20, wherein the first support beam is configured to be disposed on a first side of a strut, and wherein the ceiling support system further comprises a third support beam configured to be disposed on a second side of the strut.

24. The ceiling support system of claim 20, wherein the first support beam comprises a T-shaped cross section or an L-shaped cross section.

25. The ceiling support system of claim 20, wherein the central clip retainer comprises:

a first hook extension comprising a first clip ledge and a first lip extending from a first distal edge of the first clip ledge; and a second hook extension comprising a second clip ledge and a second lip extending from a second distal edge of the second clip ledge, wherein the first hook extension and the second hook extension are configured to receive the respective portion of the slidable joining clip therebetween.

* * * * *